United States Patent [19]

Piepers

[11] 4,388,157

[45] Jun. 14, 1983

[54] METHOD OF APPLYING COVERINGS IN THE FORM OF COMPLETELY OR NOT COMPLETELY CLOSED LOOPS

[75] Inventor: Harry C. Piepers, Eindhoven, Netherlands

[73] Assignee: Galentan AG, Zug, Switzerland

[21] Appl. No.: 353,150

[22] Filed: Mar. 1, 1982

[30] Foreign Application Priority Data

Mar. 7, 1981 [NL] Netherlands ..... 8101105

[51] Int. Cl.[3] ..... C25D 5/02; C25D 17/00

[52] U.S. Cl. ..... 204/15; 204/224 R

[58] Field of Search ..... 204/15, 224 R, 206

[56] References Cited

U.S. PATENT DOCUMENTS

| | | | |
|---|---|---|---|
| 3,819,502 | 6/1974 | Meuldijk | 204/224 R |
| 3,855,108 | 12/1974 | Bolz | 204/206 |
| 3,962,063 | 6/1976 | Hingorany | 204/224 R |
| 4,090,928 | 5/1978 | Pantiga | 204/15 |

*Primary Examiner*—T. Tufariello

*Attorney, Agent, or Firm*—FitzGibbon, Roehrig, Greenawalt & Stone

[57] ABSTRACT

A method of applying a continuous or discontinuous loop-like covering to a metal or metallized tape. The tape is guided to a first area along the periphery of a wheel and one-half of the covering is applied at the first area. The tape is guided to a second area along the periphery of the wheel in a direction opposite that in which the tape is guided through the first area along the wheel and the other one-half of the covering is applied at the second area.

5 Claims, 6 Drawing Figures

METHOD OF APPLYING COVERINGS IN THE FORM OF COMPLETELY OR NOT COMPLETELY CLOSED LOOPS

The invention relates to a method of applying continuous or discontinuous, loop-like coverings to a metal or metallized tape.

In the manufacture of products employed in electrotechnology or in electronic industry it is common practice to locally apply a covering to punched or non-punched metal or metallized tapes, the metal of said covering being usually more precious than the material of the tape. For applying such coverings noble metal such as silver, gold or palladium is usually employed.

Hitherto it has been common practice to apply such local coverings in the form of blot-shaped or strip-shaped coverings. A device suitable for applying such coverings is described, for example, in U.S. Pat. No. 3,819,502.

However, in many cases the application of such a blot-shaped covering is not necessary or even undesirable, since it may be sufficient or necessary to use a continuous or discontinuous loop-like covering, that is to say, a covering at least essentially formed, for example, by a more or less annular, elliptical or polygonal line, which may be interrupted at given spots and which surrounds a non-covered area of the tape. By applying such a loop-like covering it is not only possible to appreciably economize expensive covering material, but also to obtain in many cases an improved operation of the finished product.

In the wheel structure used in the device disclosed in U.S. Pat. No. 3,819,502 it can be imagined to arrange centrally located members in the openings provided in the wheel-shaped member to form blot-shaped coverings so that gaps corresponding to the loop-like coverings aimed at are formed. Apart from the structural difficulties involved in the disposition of such members, such members will constitute a serious hindrance for the flux of electrolyte during galvanic treatment of the metal tape so that in the area of the tape only minor refreshment of metal ions can be obtained, which will adversely affect the velocity of application of the covering material to the tape. Such a member will, furthermore, constitute an obstacle to the electric current, which brings about the risk that the covering does not have anywhere the same, required high quality.

The invention has for its object to provide a method of the kind set forth by means of which high-quality, loop-like coverings can be applied in a simple manner.

According to the invention this can be achieved in that one half of the covering is applied in a first phase and the other half of the covering in a second phase of the treatment.

By means of the method embodying the invention loop-like coverings can be effectively applied by using present-day technologies and the devices suitable for applying closed, blot-shaped coverings.

It is then feasable to apply the coverings with the aid of two consecutive, intermittently operating devices of the kind disclosed in U.S. Pat. No. 4,090,928 or to apply the coverings by passing the tape along two wheels of the type disclosed in U.S. Pat. No. 3,819,502, one half of the covering being applied in one device or with the aid of one wheel respectively and the other half of the covering in the second device or with the aid of the second wheel respectively.

When the application of the coverings is carried out with the aid of a wheel-shaped member, for example, of the kind disclosed in said U.S. Pat. No. 3,819,502, a particularly simple manufacture can be carried into effect when in the first phase of the treatment the tape is guided in a first area along the periphery of the wheel and in the second phase of the treatment the tape is guided in a second area along the periphery of the wheel in a direction opposite that in which the tape is guided in the first area along the periphery of the wheel. In this way a single wheel having suitable recesses for the electrolyte is sufficient for applying loop-like coverings to the tape.

The invention will be described more fully hereinafter with reference to the accompanying Figures.

Figure 3:
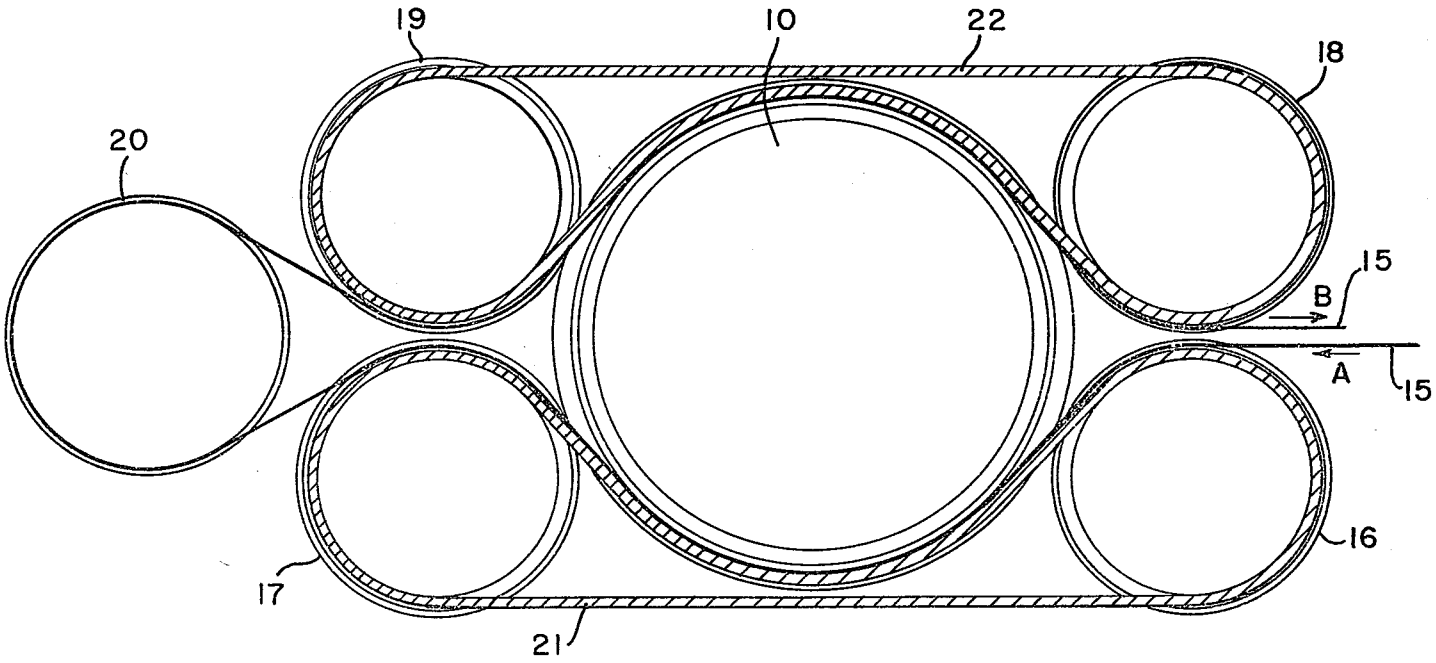

FIG. 3 schematically shows part of the device suitable for carrying out the method in accordance with the invention.

Figure 1:
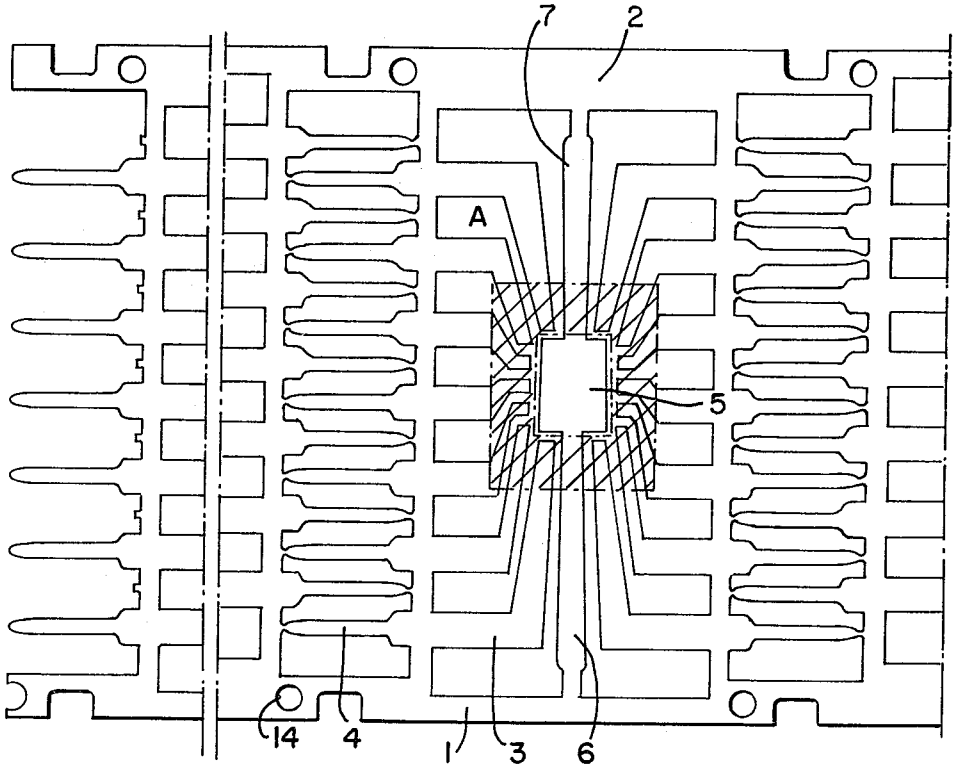
FIG. 1 is a first embodiment of a tape-shaped product to which loop-like coverings can be applied by using the method in accordance with the invention.
Figure 4:
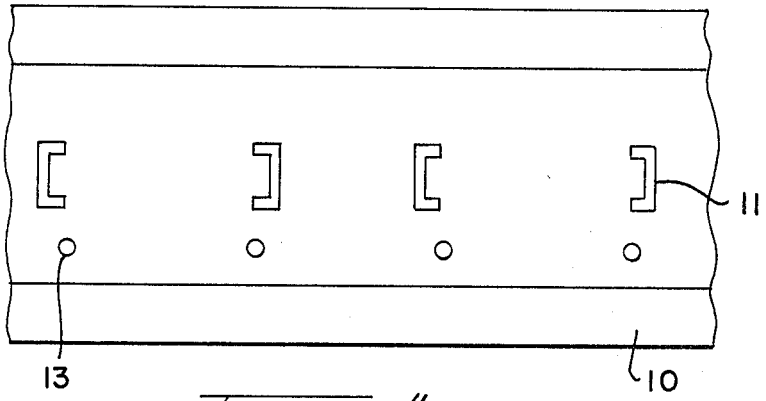

FIG. 4 is an elevational view of part of the outer periphery of a wheel with the aid of which the loop-like coverings shown in FIG. 1 can be applied.

Figure 2:
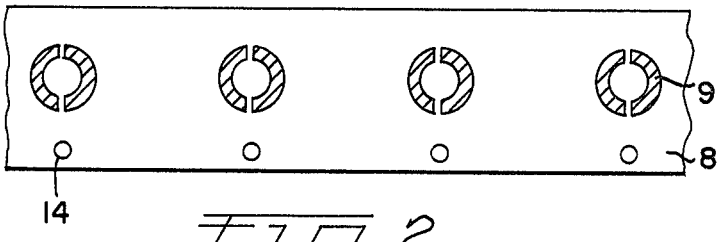
FIG. 2 shows a second embodiment of a tape-shaped product.
Figure 5:
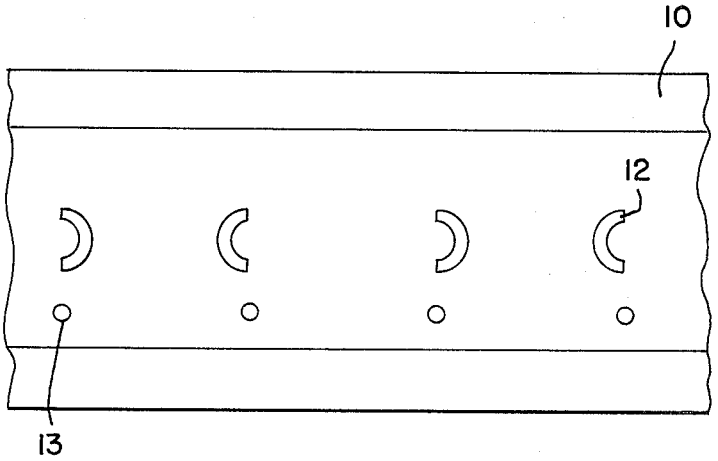

FIG. 5 is an elevational view of part of the outer periphery of a wheel with the aid of which the loop-like coverings shown in FIG. 2 can be applied.

Figure 6:
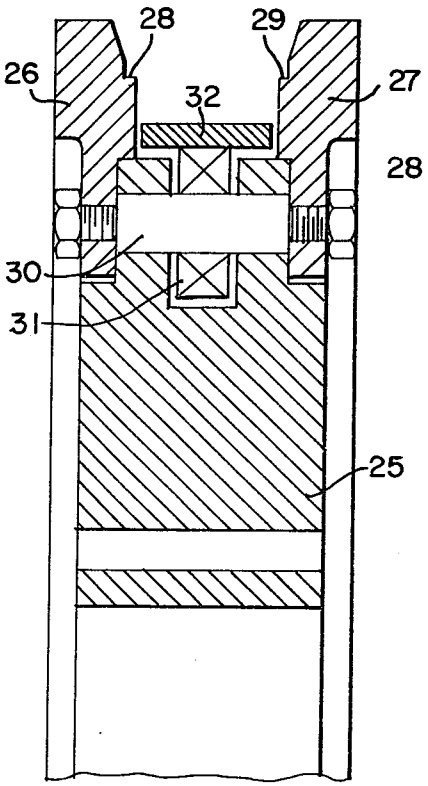

FIG. 6 is a sectional view of part of a guide wheel.

Referring to FIG. 1, a metal or metallized tape to be provided locally with blot-shaped coverings can be punched out at given areas so that such a tape essentially consists of two peripheral parts 1 and 2 more or less continuously covering the length of the tape and of intermediate-finger-shaped parts 3 and 4 and of a rectangular part 5 enclosed by the ends of the finger-shaped parts 3 and being connected by means of two tie strips 6 and 7 with the peripheral parts 1 and 2. The parts 3 to 7 constitute a single product punched together with a large number of corresponding products out of the tape so that the products still adhere to one another in order to permit of subjecting them as a tape-shaped object to a plurality of processes before the parts are separated from one another. One of these processes may be the application of a covering to the ends of the finger-shaped parts 3 located near the rectangular part 5, in which case a loop-like covering has to be locally applied to the taps as indicated in FIG. 1 by the cross-hatched surface A. In this embodiment the loop-like covering is rectangular, but obviously such covering may have any shape embracing a tape surface not to be covered. The component part shown in FIG. 1 is used in monolithic integrated circuits.

FIG. 2 shows a further product that can be manufactured by using the method embodying the invention. There is shown a metal or metallized tape 8 locally provided with loop-like coverings 9. In this embodiment the coverings are annular and not completely closed, but formed by two parts not completely covering 180° and being separated from one another by narrow, non-coated parts as will be apparent from FIG. 2. The parts of the tape 8 having such loop-like coverings 9 can be used as annular contact surfaces for rotatable switches or, for example, as slip rings in electric motors.

For applying such loop-like coverings it is preferred to use a device as is schematically shown in FIG. 3.

This device comprises a wheel 10, the outer periphery of which has equidistant, U-shaped recesses 11 for applying loop-like coverings as shown in FIG. 1 (FIG. 4). If coverings of the type shown in FIG. 2 have to be applied, the outer periphery of the wheel has substantially semi-circular gaps 12 of the kind shown in FIG. 5.

As is shown in FIGS. 4 and 5, the outer periphery of the wheel is provided with indexing pins 13 adapted to co-operate with indexing holes 14 made for this purpose in the tape to be worked (FIGS. 1 and 2).

The wheel may furthermore have means for the supply of electrolyte to a tape 15 guided around the wheel and to be provided with coverings, said tape having the function of a cathode as well as to an anode, for example, in the manner described in U.S. Pat. No. 3,819,502.

FIG. 3 furthermore shows that for guiding the tape 15 along the periphery of the wheel four guide wheels 16 to 19 as well as a reversing wheel 20 are provided. Around the two guide wheels 16 and 17 is passed an endless supporting tape 21 of elastic material, for example, rubber and a similar tape 22 is passed around the two guide wheels 18 and 19. With respect to the centre of the wheel 10 the guide wheels 16 and 17 with the supporting belt 21 are located diametrically opposite the guide wheels 18 and 19 with the supporting belt 22 so that the supporting belt 21 extends along a first part of the wheel periphery and the supporting belt 22 along a diametrically opposite part of the wheel periphery.

In operation the tape to be worked is fed in the direction of the arrow A from a reel or the like (not shown), after having been pretreated in cleaning and/or degreasing baths or the like. With the aid of the supporting belt 21 the metal or metallized tape is guided through a given arc along the periphery of the wheel 10, whilst the supporting belt 21 firmly urges the tape 15 against the periphery of the wheel and covers the passages in the tape so that the electrolyte sprayed through the orifices 11 or 12 against the tape cannot reach the rear side of the tape.

During this travel of the tape 15 in this area along the periphery of the wheel coverings are applied to the tape in conformity with the shape of the recesses 11 or 12 in the periphery of the wheel.

Subsequently the tape 15 is reversed around the reversing wheel 20 and guided with the aid of the guide wheels 19 and 18 and the supporting belt 22 at a second area along the outer periphery of the wheel 10. During the travel of the tape along the wheel in this second area coverings joining the coverings previously formed are applied to the tape with the aid of the recesses 11 and 12 of the wheel so that after the tape has passed said second area of the wheel 10 the desired loop-like coverings are obtained on the tape. The tape 15 then leaves the device in the direction of the arrow B, at least substantially parallel to but opposite the direction in which the tape is supplied. The tape may subsequently be passed through further processing baths or the like and be again wound on a reel or the like.

It will be obvious that in this way with the aid of a single wheel of simple structure continuous or discontinuous loop-like coverings can be applied to a metal or metallized tape. If necessary, as the case may be, the tape can be guided in a similar manner along a plurality of wheels for applying analogous coverings.

A further advantage of the arrangement shown in FIG. 3 and described above is that the tape can leave the galvanizing stage in the same direction as that in which it is supplied. Therefore, the devices through which the tape has to be passed prior to and after the galvanic treatment for example, various processing baths can be disposed side by side in contrast to the conventional arrangement in which such devices are all disposed one behind the other, so that space can be saved.

A further advantage of the method according to the invention is that large part of the wheel periphery is effectively utilized so that a favourable ratio between the cost price of the galvanizing device and the productivity thereof is obtained.

In order to correctly apply the adjoining parts of the blot-shaped coverings the tape has to be guided with respect to the wheel in a very accurate manner. This method is, therefore, particularly suitable for use in a device as described in copending Dutch Patent Application No. 8,101,105 filed Mar. 7, 1981.

Due to differences between the properties of the materials and between the radii of curvature of the tape 15 and the supporting belt 21 or 22, when guided along a guide wheel, the supporting belt and the metal or metallized tape, when passed together around a guide wheel, tend to relatively shift in place, which results in undesirable displacements of the tapes and/or the exertion of undesirable forces on the tapes.

In order to mitigate said disadvantage successful use can be made of the structure of a guide wheel as illustrated in FIG. 6. The guide wheel shown in said Figure comprises an annular body 25, on both sides of which flanges 26 and 27 projecting beyond the circumference of the body 25 are clamped with the aid of bolts 28. The proximal sides of the annular flanges 26 and 27 are provided with uninterrupted shoulders 28 and 29 respectively, which serve in operation for supporting the metal or metallized tape 15.

Rollers 31 are freely rotatable about pins 30 provided in the body 25 and extending parallel to the rotary axis of the annular body 25. The rollers 31 support an annular tape 32 forming a second wheel and serving to hold the supporting belt 21 or 22 respectively, said wheel being freely rotatable with respect to the wheel supporting the metal tape and comprising the flanges 26 and 27.

It will be obvious that when, for example, in the device shown in FIG. 3 the guide wheels 16 to 19 are constructed as described above with reference to FIG. 6, the metal tape 15 can bend independently of the supporting belts 21 and 22 respectively so that the aforesaid disadvantages are avoided.

According to the invention guiding the tape twice along the same wheel may also be practised for closed, blot-shaped coverings in order to obtain a layer having approximately twice the thickness of that obtained in guiding the tape once along the wheel.

What is claimed is:

1. A method of applying continuous or discontinuous loop-like covering to a metal or metallized tape comprising the steps of:

guiding the tape to a first area along the periphery of a wheel;

applying one-half of the said covering at said first area in a first phase of the process;

guiding the tape in a second area along the periphery of the wheel in a direction opposite that in which the tape is guided through the first area along the wheel; and applying the other one-half of the covering at said second area in a second phase of the process.

2. A device for applying a continuous or discontinuous loop-like covering to a metal or metallized tape wherein one-half of the covering is applied in a first phase and the other half of the covering is applied in a second phase of the application, comprising a wheel, the outer periphery of which has passages, the shape of said passages correspond to one-half of said loop-like cover to be applied.

3. A device as set forth in claim 2 wherein an electrolyte can pass through said passages.

4. A device as set forth in claim 2 further including two pair of guide wheels along which the tape to be covered travels, said guide wheels being arranged near said wheel, a pair of supporting belts arranged about each pair of said guide wheels in a manner such that said supporting belts extend along at least a substantially diametrically opposite parts of said wheel, and a reversing wheel interposed between one each of said pair of guide wheels to permit travel of the tape to be covered from the first phase to the second phase.

5. A device as set forth in claim 2 or 4 wherein said wheel further includes two projected flanges having supporting faces for the tape on proximal sides, and a wheel-shaped supporting member positioned between the flanges so as to be rotatable independent of the flanges, such that the diameter of said wheel-shaped supporting member is smaller than the diameter of said supporting member.

* * * * *